US005894682A

United States Patent [19]

Broz

[11] Patent Number: 5,894,682

[45] Date of Patent: Apr. 20, 1999

[54] SHOE WITH BUILT-IN DIAGNOSTIC INDICATOR OF BIOMECHANICAL COMPATIBILITY, WEAR PATTERNS AND FUNCTIONAL LIFE OF SHOE, AND METHOD OF CONSTRUCTION THEREOF

[76] Inventor: Joseph S. Broz, 4885 Kings Ridge Blvd., Boulder, Colo. 80301

[21] Appl. No.: 08/832,203

[22] Filed: Apr. 8, 1997

[51] Int. Cl.[6] ..... A43B 13/14

[52] U.S. Cl. ..... 36/31; 36/8.4; 36/1

[58] Field of Search ..... 36/1, 8.4, 25 R, 36/31, 15, 39, 42, 61

[56] References Cited

U.S. PATENT DOCUMENTS

| | | | |
|---|---|---|---|
| 2,187,621 | 1/1940 | Hanus | 36/42 |
| 2,706,509 | 4/1955 | White | 152/209 |
| 3,258,805 | 7/1966 | Rossnan | 15/110 |
| 3,362,376 | 1/1968 | Norton | 116/114 |
| 3,578,055 | 5/1971 | French et al. | 152/330 |
| 3,631,614 | 1/1972 | Rice | 36/61 |
| 3,929,179 | 12/1975 | Hines | 152/330 A |
| 4,130,947 | 12/1978 | Denu | 36/30 R |
| 4,271,608 | 6/1981 | Tomuro | 36/61 |
| 4,274,211 | 6/1981 | Funck | 36/30 R |
| 4,364,188 | 12/1982 | Turner et al. | 36/31 |
| 4,715,133 | 12/1987 | Hartjes et al. | 36/127 |
| 4,845,863 | 7/1989 | Yung-Mao | 36/114 |
| 4,887,367 | 12/1989 | Mackness et al. | 36/28 |
| 5,289,647 | 3/1994 | Mercer | 36/134 |

*Primary Examiner*—M. D. Patterson

*Attorney, Agent, or Firm*—Greenlee, Winner and Sullivan, PC

[57] ABSTRACT

The invention provides a shoe having a built-in wear-indicator device capable of signalling (a) extent of shoe wear, (b) biomechanical compatibility with the user, (c) loss of the ability to cushion and absorb shock, and (d) a need for shoe replacement. The built-in wear-indicator device is positioned within the midsole and/or outsole and must be made of a material that is less compactible than the surrounding bulk midsole material that functions conventionally to cushion and absorb shock. With prolonged wear the midsole material loses its ability to absorb shock and compacts in the vertical dimension. In contrast, the wear-indicator device, being less compactible than the midsole, continues to protrude into the outsole in response to downward forces exerted on the indicator device. The degree of extension of the wear-indicator device into the outsole is an indicator of loss of ability to cushion and absorb shock and, consequently, of a need for shoe replacement. The invention further provides a shoe having a built-in wear-indicator outsole capable of detecting erosion of the shoe outsole surfaces, which is correlated with midsole compaction and loss of ability to cushion and absorb shock.

41 Claims, 8 Drawing Sheets

SHOE WITH BUILT-IN DIAGNOSTIC INDICATOR OF BIOMECHANICAL COMPATIBILITY, WEAR PATTERNS AND FUNCTIONAL LIFE OF SHOE, AND METHOD OF CONSTRUCTION THEREOF

FIELD OF THE INVENTION

This invention relates generally to shoes comprising a built-in device capable of accurately indicating the useful life of a shoe and diagnosing the wear profile useful in predicting the need for shoe replacement and in injury prevention.

BACKGROUND OF THE RELATED ART

In general, active-wear shoes are conventionally constructed to have four separate layers: an outsole, a midsole, an upper top layer and, in most shoes, an insole. The outsole or bottom layer is made of a durable material that extends across the lowest surface of the shoe. The midsole or middle layer is situated atop the outsole to provide a cushioning layer to the wearer's foot. Usually, the upper or top layer, formed of leather, synthetics or other materials, is joined to the midsole. Additionally, in most conventional shoes, an insole is further provided for disposal between the midsole and the wearer's foot.

The midsoles of conventional shoe constructions function as shock absorbers to cushion the wearer's foot. The midsole, which usually comprises a plurality of cushioning elements, has the property of deforming over a large area of surface in response to a downward force exerted on the surface. The compression and decompression characteristics of the midsole layer, which are designed and selected to accommodate a particular weight class or cushionability preferences of wearers, are important not only to the comfort of the shoe but also to the functionality and longevity of the shoe.

Consumers of shoes, in particular running shoes and athletic shoes used for a variety of sports, are concerned foremost with (a) the need to select a shoe that is a correct biomechanical fit for the individual and for the particular athletic utility and (b) the need to know when a shoe needs to be replaced, in particular when the shoe loses its ability to provide sufficient cushioning or shock-absorbing effects and/or when the outsole wear inhibits proper function.

In an industry that encompasses an estimated annual market of several billion dollars worldwide, the issues of cushioning, comfort and proper fit of shoes have far-reaching impact on the rate of consumer re-purchase and product satisfaction. Consumers want a specific type of shoe that is best for their particular body-type and biomechanical character, and one which will compensate for any foot, leg or posture problems they may have. Additionally, the consumer needs to know when their shoes need to be replaced with a new pair, which is a question of some significance since the average investment in athletic shoes is not insignificant. Premature retirement of the shoes by 10–15% could cost the consumer public a significant unwarranted expense but, on the other hand, delayed replacement of shoes can cause pain and severe and debilitating injury.

Most authorities, running books and sports advisors place the useful life of a running shoe, for instance, at between 300 and 500 miles (see for example *Running Injury Free,* Ellis J., and Henderson, J., Rodale Press, 1994). The reasoning for this is simply that it is the midsole of the shoe that provides for most of the shock absorption but it loses its cushioning ability naturally because the midsole material breaks down due to the constant compression and decompression that occurs during running or other athletic activity. Thus, a need still exists for a customized detection system that is responsive to the individual foot motion and to a specific sport or activity and that, in an individualized way, alerts an athlete or general consumer as to the extent of loss of shock-absorbing capacity of the shoe, and the need for shoe replacement.

Additionally, physical wear of the outsole, the part of the shoe that makes contact with the ground or tread surface, is a serious issue impacting the functionality of a shoe. When outsoles wear down, potentially severe biomechanical imbalances can occur and cause injuries. Further, basic traction can be seriously compromised which is a danger to the wearer on any surface. Hence, there exists a continuing need for a device to detect and to signal the wearer as to the extent of outsole wear and the need to replace the shoe.

The present invention describes shoes having a built-in wear indicator device incorporated into the midsole and/or outsole construction that serves as (a) an indicator of outsole wear, (b) an indicator of the ability (or loss of ability) of the shoe to absorb shock, and (c) the need for shoe replacement. This invention finds application in not only athletic shoes but also safety shoes, corrective shoes and ordinary street shoes. Additionally, specialty shoes, such as ski boots, etc., also have a need for the present invention to ascertain a correct fit and to detect and monitor the progressive wear profile, in order to maintain the proper functioning of specific athletic shoe equipment.

SUMMARY OF THE INVENTION

The principal object of the present invention is to provide a shoe having a built-in indicator device capable of signalling (a) extent of shoe wear, (b) biomechanical compatibility with the user, (c) loss of the ability to cushion and absorb shock, and (d) a need for shoe replacement.

The present invention provides a shoe having an outsole made of durable material to withstand ground contact and wear, a midsole comprising cushioning material of resilient deformability and adjustable compressibility efficient in absorbing shock, and a built-in wear-indicator device that is (a) comprised within the outsole or (b) positioned in the midsole with extension or protrusion into the outsole or (c) a combination of (a) and (b). A shoe provided by the invention is an activewear shoe, comprising running shoes, athletic shoes, aerobic shoes, court shoes, walking shoes, street shoes, safety shoes, corrective shoes, ski boots, sport shoes and the like.

In a particular embodiment, the invention provides a built-in wear-indicator device that has a shape compatible with an indicator function of the invention, e.g., forming the shape of a cone, a plug, a rectangle, a stripe, or any other suitable geometric structure positioned in the midsole, spanning the thickness of the midsole either completely or partially from the bottom midsole surface into the midsole compartment, and extending further into the outsole.

This built-in, midsole/outsole wear-indicator device or protrusion structure must be made of a material that is less compactible, i.e., has a slower rate of breakdown, a smaller loss of resiliency, and less compaction, than the surrounding bulk midsole material that functions conventionally to cushion and absorb shock.

According to the invention, as the midsole material breaks down and loses its ability to absorb shock, it compacts and contracts in the vertical dimension; the wear-indicator device, in contrast, by virtue of breaking down more slowly and losing its compressibility less rapidly, retains substantially its vertical dimension and, consequently, projects further out from the bottom of the midsole into the outsole in response to forces exerted on the indicator device. The increase in degree of extension of the wear-indicator device into the outsole is a means for indicating compaction, serving as an indicator of the loss of midsole cushioning capability due to breakdown of the midsole and its increasing inability to absorb shock.

The wear-indicator device need not necessarily be aligned for the normal angle of incidence to the ground or outsole surface to be effective in its function. The invention also contemplates protrusion structures situated co-parallel along the principal axes of vectorial force sustained or encountered during use of the shoe in athletic activity.

With extended wear, the protrusion of the built-in wear-detector device into the outsole becomes detectable to the wearer upon inspection of the bottom of the shoe. In particular embodiments, the invention provides a wear-indicator device that comprises at its protruding end a distinctive material or feature, for example, a color (or other easily detectable tag or signal) that is distinct and distinguishable from the bottom surface of the outsole. Thus, the appearance and visibility of the distinct color of the wear-indicator device is a means for indicating compaction which signals to the shoe wearer that a high level of midsole material breakdown and compaction is occurring with a concomitant loss of shock-absorptive capability, and that the shoes need replacement.

The invention also provides a wear-indicator device that is multi-colored, i.e., comprising layers of different colors. For example, when the wear-indicator device is initially observed upon inspection of the shoe bottom, it possesses a first color, e.g., green.

Then, with continued wear and enhanced breakdown and compaction of the midsole and further extension of the wear-indicator device into the outsole, the first color (green) erodes, giving way to a second or sequential color, each successive color signalling to the wearer a higher level of midsole material breakdown and a lesser level of shock-absorptive character of the midsole and a need for shoe replacement.

It is a further object of the invention to provide a wear-indicator device that is diagnostic of biomechanical compatibility between the shoe and the user and that is diagnostic of specific patterns of wear characteristic of, for example, a rolling motion of the foot as in pronation/supination, a lack of proper support, inadequacies in shoe fit, fatigue, injuries, etc.

In particular is provided a built-in wear-indicator device that has the shape of a rectangular parallelepiped or other such conventional geometry, that can appear as a stripe along the bottom of the outsole.

Preferably, this wear-indicator stripe, or pronation/supination stripe, has a curvature in medial-lateral cross-section to facilitate the detection of wear and midsole material compaction due to pronation or supination action resulting from a rolling motion of the foot. Under usual conditions, the stripe would be expected to wear differentially and to produce a characteristic and/or expected wear pattern, for example, the central area of the wear-indicator stripe might be expected to wear sooner and deeper than the ends of the stripe. Any deviation from the expected pattern of wear in the wear-indicator stripe would signal an unusual foot characteristic. Thus, the curvature feature of a wear-indicator device, by indicating the degree of compaction and wear in the critical extremities of the midsole and outsole, not only can account for the rolling action of the foot but also can serve as a useful indicator of the extent of pronation/supination in an individual wearer, in addition to indicating the serviceable life of the shoe to support and correct conditions of over-pronation or over-supination.

The present invention also provides a wear-indicator stripe, or pronation stripe, that is constructed in such a manner that it is not visible initially from the bottom of the shoe and is contained entirely within the midsole/outsole regions. With extended shoe usage, the outsole erodes to expose a wear-detection signal of the wear detection device, indicating excessive wear and/or midsole compaction. The advantage presented by this embodiment of the invention is that the midsole and the wear-indicator device are sealed off by the outsole, making the construction of the shoe more conventional and easier to manufacture using existing technologies for outsole to midsole bonding.

It is an additional object of the invention to provide a wear-indicator device that is consonant with the outsole, forming a wear-indicator outsole.

The invention provides a wear-indicator outsole that is comprised of a plurality of layers, each layer being distinct and distinguishable from the other layers. The function of the wear-indicator outsole is to indicate the extent of wear by revealing each successive layer of the outsole as the exterior surface of the outsole continues to wear away through use. The extent of wear of the outsole is correlated with midsole compaction and loss of ability to cushion and absorb shock. In a preferred aspect of this embodiment, the different layers are color-coded such that upon observing a particular color at the exterior surface of the outsole, a consumer is alerted to a condition of excessive wear and a need for shoe replacement.

The invention also provides a wear-indicator outsole that is fashioned to comprise wear blisters, which are outpockets of the outsole, providing contact points between the ground surface and the outsole. Wear blisters are designed to be the first areas of the shoe to exhibit wear. In a specific aspect, the wear blisters comprise a plurality of layers, each of which is distinct and distinguishable from the other layers. Preferably, each of the different layers possesses a distinct and distinguishing color, or other easily detectable feature. With continued wear, the appearance or visualization of a particular layer, or color of layer, of wear blister when viewed from the shoe bottom is a signal to the consumer of excessive wear and a need for shoe replacement.

The present invention further provides a wear-indicator outsole that is a filled wear blister. In this embodiment, the wear blister is filled with conventional outsole material comprising a distinct and distinguishing feature, as exemplified by a distinct color or other such easily detectable tag. With wear, the distinct tag of the wear blister filling material is revealed, signalling to the consumer that the shoe is wearing and, by further indirectly correlating the compaction of the midsole material to the actual shoe wear, indicating a need for shoe replacement.

Additionally, the invention provides a shoe having a built-in wear-indicating function resulting from a means for indicating compaction comprising a combination of a midsole/outsole wear-indicator device with a wear-indicator outsole. In these cases, the wear indicator outsole or wear blister resides underneath a midsole/outsole wear indicator device to receive specific wear forces. The resultant compaction and loss of resiliency of the midsole directly contributes to the wear and revelation of the various layers of the outsole, signalling a need for shoe replacement.

Specific applications of wear detection devices are known in the art, for example:

A means for indicating wear of tire tread was proposed by White in U.S. Pat. No. 2,706,509, issued Apr. 19, 1955. This patent provides a vehicle tire tread wear-measuring means, integral with the ribs of the tire tread and extending into the grooves of the tire tread, such that the wear-measuring means will indicate at all times, by visual inspection, the amount of wear and the remaining potential wear in a tire.

Also, a tire tread wear indicator was disclosed by Hines in U.S. Pat. No. 3,929,179, issued Dec. 30, 1975. In this case, a tread depth indicator is incorporated in a vehicle tire tread such that the body of the indicator wears away at not less than the same rate as the tire tread. In the indicator, an outwardly facing region is located at about the maximum desired depth for the tread to wear down, providing an indication when the tread wears down to that depth.

In U.S. Pat. No. 3,258,805, Rossnan discloses a toothbrush capable of giving visual indication when the brush is ready to be discarded. The toothbrush comprises synthetic bristles, each of which is coated entirely with rubber. The bristles are of a different color than the rubber coating so that when the rubber coating is worn to exhibit the synthetic bristles, it warns the user that the brush should be discarded.

The utilization of wear-indicator devices built into athletic shoes or other shoe constructions is not known in the art.

BRIEF DESCRIPTION OF THE DRAWINGS

Various aspects of the invention and their advantages will be more completely understood by reference to the following Detailed Description in conjunction with the appended drawings in which:

FIG. 1 presents isometric views of preferred embodiments of the invention.

FIG. 2 presents cross-sectional side views of preferred embodiments of a wear-indicator device. As shown in FIG. 2D, the degree of extension can be facilitated by coloring the inside of the outsole protrusion cup with an indicating color.

FIG. 3 presents views of a wear-indicator stripe (a pronation/supination stripe).

FIG. 5 illustrates a bottom view of a shoe containing built-in wear-indicator devices of the invention producing a specific wear pattern. FIG. 5B exemplifies a wear-pattern potentially caused by an over-pronator, while

DETAILED DESCRIPTION OF THE INVENTION

The following definitions are given in order to provide clarity as to the intent or scope of their usage in the specification and claims.

The term a built-in wear-indicator device, as used herein, relates to a structure made of a material that is less compactible than the surrounding bulk midsole material used to cushion and absorb shock and incorporated into the midsole and/or outsole in such a way that the built-in wear-indicator device protrudes into the outsole as a function of the extent of shoe wear and enhanced compaction of the midsole, signalling to the wearer a loss of ability to cushion and absorb shock and a need for shoe replacement.

The term a built-in wear-indicator outsole, as used herein, relates to a built-in wear-indicator device that is consonant with the outsole, i.e., an outsole modified to function as an indicator capable of signalling (a) extent of shoe wear, (b) loss of ability to cushion and absorb shock, and (c) a need for shoe replacement.

The terms compression or compressing or to compress, as used herein, relate to the ability to be pressed together or deformed or squeezed or made more compact, for example, by pressure.

The terms resilient and resiliency, as used herein, relate to the ability to recover from compression, to bounce back into shape, position, etc., after being pressed or stretched, etc.

The terms compaction, compactible, compactibility and to compact, as used herein, relate to an irreversible or non-resilient rearrangement into a smaller and denser space.

The term compacted, as used herein, relates to the inability to recover from the state of being compressed.

The term a rectangular parallelepiped, as used herein, refers to a specific example of a geometric figure which, in general, relates to a six-sided solid comprising sides having a general shape of a regular or irregular rectangle, parallelogram, etc. and which may be further exemplified by a cube, prism, etc.

The term carbon rubber, as used herein, refers to a durable type of rubber outsole material made from solid rubber with a carbon additive that improves durability.

The term vertically disposed, as used herein, relates to an upright position that includes, for example, a perpendicular, a sloping, a slanted, a canted or other non-horizontal position.

The term bulk midsole material, as used herein, refers to components of the midsole accounting for the major portion of the midsole composition and functioning conventionally to absorb shock and cushion a wearer's foot.

Figure 1A:
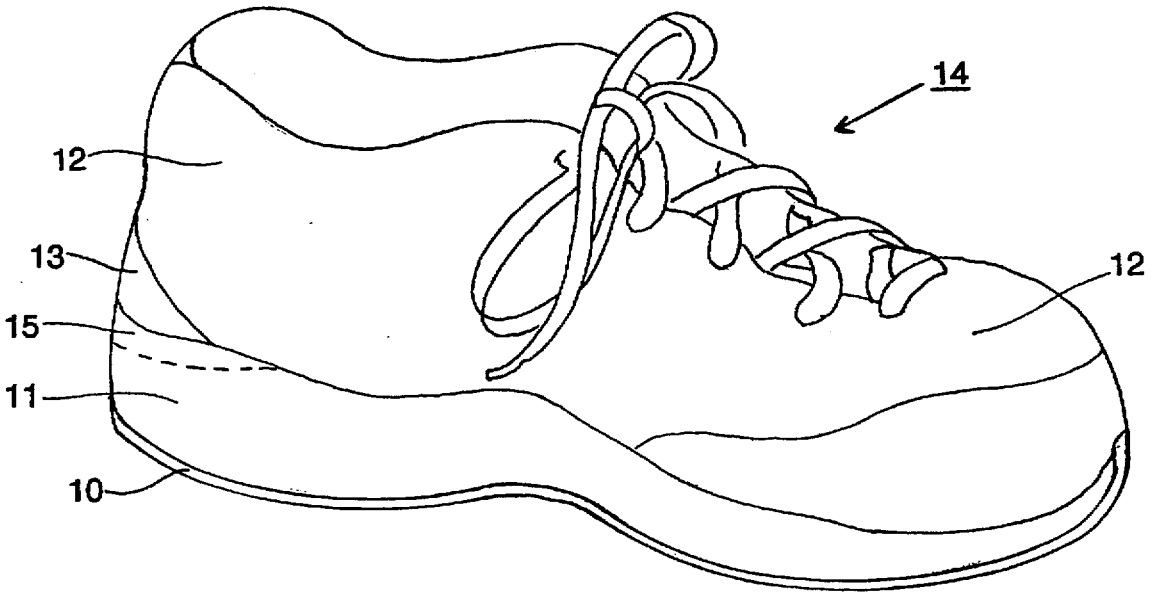
FIG. 1A illustrates an outsole, midsole and upper, as well as a heel wedge and heel cup.

Referring to FIG. 1, isometric views of a particular embodiment of a shoe construction according to the invention are shown. In FIG. 1A, an outsole is indicated generally at 10; a midsole is indicated generally at 11; and an upper is indicated generally at 12. A heel cup 13 is shown in FIG. 1A as fitted into the back of an activewear shoe indicated generally at 14. Further, a heel wedge 15 is shown to be inserted at the back of the shoe between heel cup 13 and midsole 11.

While the illustrated shoe 14 is one designed for running, the invention can also be employed in other types of athletic shoes, such as walking, aerobics, court shoes, etc. The invention is also useful in other types of shoes such as safety shoes, corrective shoes, street shoes, ski boots, and the like.

Figure 1B:
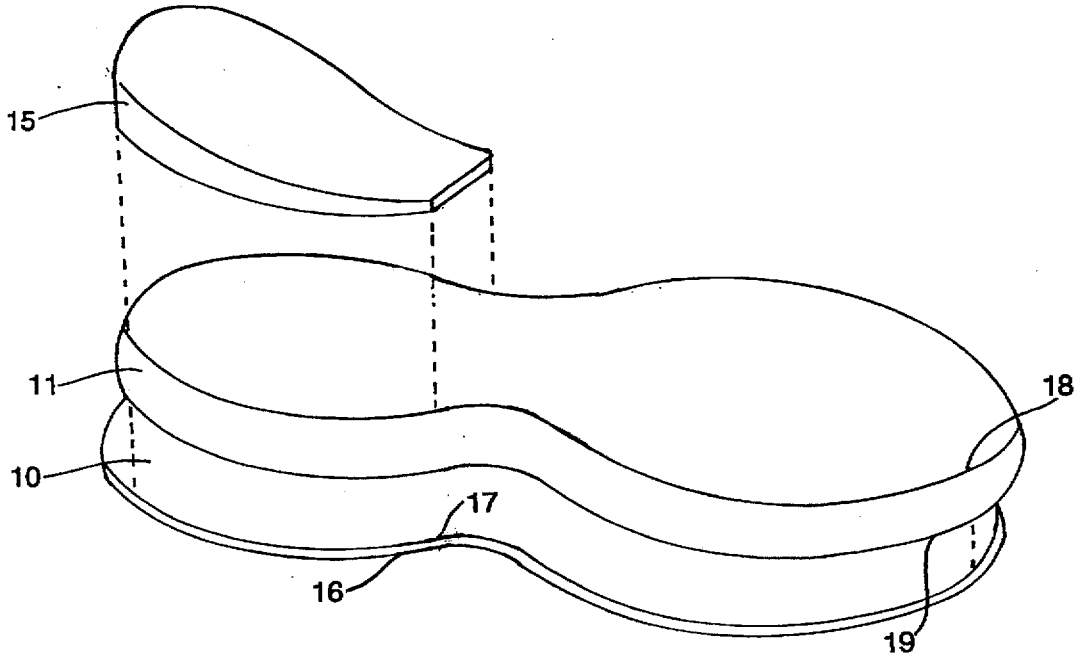
FIG. 1B illustrates a midsole separated from the outsole and a heel wedge.

Shoe 14 is comprised of an outsole 10 that forms the wearing surface of the shoe. In FIG. 1B, the outsole 10 is spatially separated from the midsole 11. Outsole 10 is preferably constructed of a relatively durable, resilient material such as carbon rubber. Outsole 10 has an exterior surface 16 that is provided with a suitable tread surface 29. The outsole 10 further has an interior or upper surface 17 which may be smooth or reticulated or webbed throughout or in part.

Shoe 14 is also comprised of a midsole 11 that forms the shock-absorbing and cushioning layer of the shoe. Midsole 11 can be constructed of foam materials of ethylene vinyl acetate (EVA), polyurethane (PU), or the like, or a combination thereof, or can be constructed of a plurality of air bladders and/or gel packs, having comb structures, hexalite gridded support networks, etc., or of a variety of other components designed to absorb shock from ground impact forces. Midsole 11 has an upper surface 18 and a lower surface 19, as illustrated in FIG. 1B.

Figure 1C:
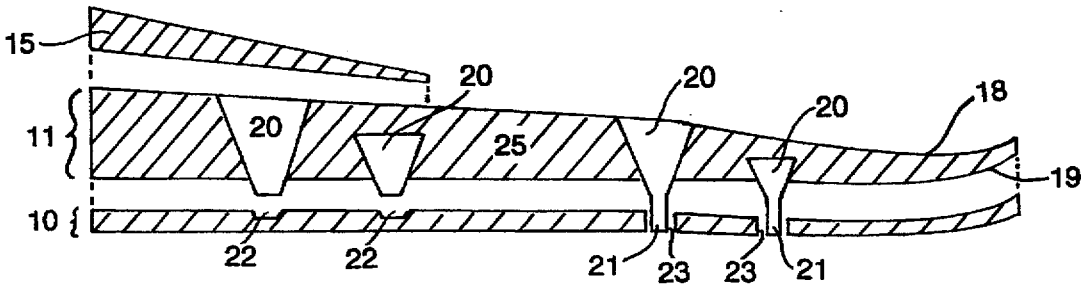
FIG. 1C schematically illustrates an outsole/midsole assembled unit in which a conically-shaped protrusion structure spans either completely or partially through the midsole and further extends into the outsole, into either an outsole protrusion inset or an outsole protrusion cup.

According to embodiments of the invention as shown in FIG. 1C, both outsole 10 and midsole 11 are penetrated vertically, either completely or partially, by a protrusion structure 20. It is highly preferred that a plurality of protrusion structures 20 be incorporated into the outsole 10 and midsole 11. The protrusion structures 20 may be distributed evenly or randomly or with particular bias toward a specific area of the shoe. As shown in FIG. 1C, the protrusion structures are designed as conical structures, the cross-sectional variation providing a means for indicating the extent of protrusion thereof, but the invention contemplates other structural geometries that fulfill the requirements of the invention. Although it is not necessary that the protrusion structure 20 begin at the upper surface of the midsole 18, it is preferred that the protrusion structure 20 span the thickness of the midsole. The protrusion structure 20 penetrates through the bottom of the midsole 19 and extends into the outsole 10. The part of the protrusion structure 20 extending into the outsole, designated as the protrusion nipple, is generally indicated as 21 in FIG. 1C.

The outsole 10 is modified to provide for the protrusion nipple 21. In one embodiment illustrated in FIG. 1C, the outsole 10 comprises an inset within the outsole (outsole protrusion inset indicated as 22) to receive the protrusion nipple 21 or by cutting a hole through the outsole to form a cup (outsole protrusion cup indicated as 23) sufficient to accommodate the protrusion nipple 21. The outsole protrusion inset 22 and the outsole protrusion cup 23 exemplify, but do not limit, the use of other structural geometries to accommodate the protrusion structures.

It is of particular importance to the present invention that the protrusion structure or structures 20 be less compactible, i.e., have a slower rate of breakdown and compaction, than the midsole material 25 making up the bulk of the midsole 11. According to the invention, as the bulk material 25 of the midsole 11 breaks down as a function of wear, it loses its ability to absorb shock and, consequently, the midsole compacts and contracts in the vertical dimension. Under these same conditions, the protrusion structures 20, in contrast, break down more slowly and lose their compressibility and compact less rapidly. As a result, the protrusion structures 20 retain substantially their vertical dimensions and cause the protrusion nipples to extend further from the bottom of the midsole 19 into, for example, the outsole protrusion insets 22 or the outsole protrusion cups 23. The degree of this extension of the protrusion structures 20 into the outsole is an indicator of the breakdown and compaction of the midsole composition and the increasing inability of the midsole to absorb shock. Regardless of the specific materials used to construct the midsoles 11, outsoles 10 or protrusion structures 20, it is of paramount importance to the present invention that a differential rate of breakdown and compaction occur between the protrusion structures 20 and the midsole material 25 in order to enable growth of the protrusion nipples 21 relative to the more rapidly compacting midsole material 25.

Presented in FIG. 2 are additional preferred embodiments of the invention. In FIG. 2A, protrusion structures 20 are illustrated as having the shape of, for instance, a cylindrical plug, although the shape of the protrusion structure 20 can be varied, as long as it remains functional according to the invention. Also, the length of the protrusion structure 20 through the midsole 11 is variable, as shown in FIG. 2A. For example, the protrusion structure can span the midsole completely, i.e., starting from the upper surface of the midsole 11 and extending to the lower surface of the midsole, or partially, i.e., starting at a distance from the upper surface of the midsole 11 and extending to the midsole lower surface. This variability in length of the protrusion structure 20 is important, for example, when the protrusion structure 20 is used in combination with, e.g., gel packs or other midsole constructions. In these cases, the protrusion structure 20 can be installed underneath the other midsole components located in the inner compartment of the midsole, generally indicated as 25.

Figure 2A:
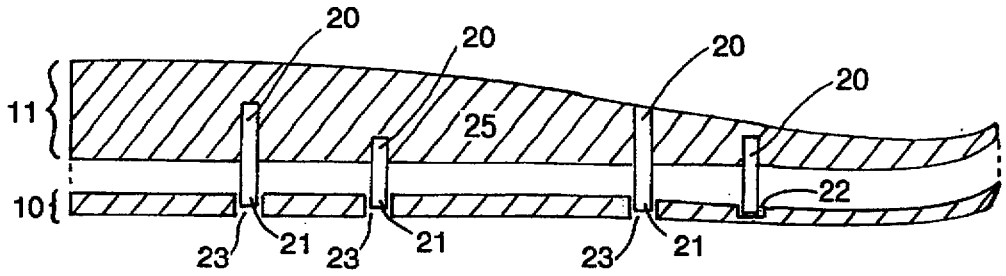
In FIG. 2A, where the midsole is schematically separated from the outsole, are illustrated protrusion structures in the shape of cylindrical plugs of variable lengths extending through the midsole and protruding into the outsole. The protrusion structure extension into the outsole (protrusion nipple) extends either into an outsole protrusion inset or into an outsole protrusion cup.
Figure 2B:
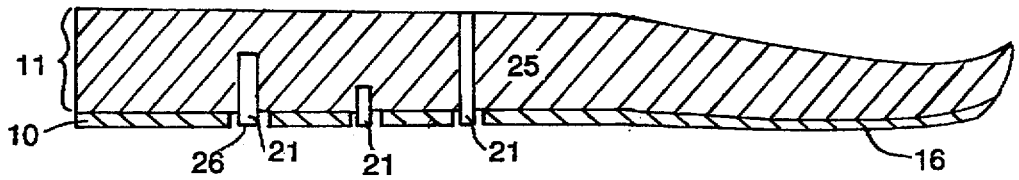
FIG. 2B illustrates an assembled midsole/outsole unit in which the protrusion structures are of variable length to accommodate specific midsole designs, and which, with wear, are forced onto the ground surface.

FIG. 2B presents an assembled unit in which the outsole 10 is connected to the midsole 11. In the specific embodiment of FIG. 2B, the length of the protrusion nipple is variable, but is initially placed flush with the outsole exterior or bottom surface 16. The bottom surface of the protrusion nipple 26 can be coated with, or appended to, a distinctive and easily detectible material that will indicate wear of the protrusion nipple 21 as the midsole 11 undergoes compaction and/or breakdown and the protrusion structure 20 is forced further onto the ground surface.

Figure 2C:
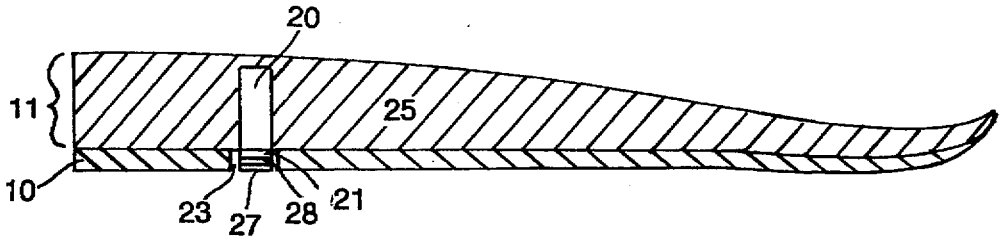
In FIG. 2C is illustrated a protrusion structure spanning through the midsole and extending into an outsole protrusion cup to the ground. The protrusion nipple extending into the outsole is capped at the bottom end with a wear-indicator material (e.g., having a distinct first color), overlayed with a wear-replacement material (e.g., having a distinct second color).

FIG. 2C illustrates an embodiment of the invention in which a protrusion structure 20 having the shape of a cylindrical plug is capped at the bottom end of the protrusion nipple 21 with a wear-indicator material, indicated generally as 27, which is distinguishable, preferably visually, e.g., by a change in color, from the material making up the protrusion nipple proper 21, the change in material providing a means for indicating the extent of protrusion thereof. In this case e bottom end of the protrusion nipple 21 comprises the wear-indicator material 27. When the wear-indicator material is eroded or worn away, the bottom surface of the protrusion nipple proper 21 is revealed, for example, by the appearance of a specific color. At this point, the wearer of the shoe would be signaled to consider replacement of the shoe. For added emphasis, a replacement-indicator material 28 can further be incorporated into the protrusion nipple 21, for example, by insertion of the replacement indicator material 28 between the bottom of the protrusion nipple proper 21 and the wear-indicator material 27. The replacement-indicator material 28 is distinguished, preferably visually, from the protrusion nipple proper 21 and the wear-indicator material 27. In this embodiment, it is preferred that the protrusion nipple 21, the wear-indicator material 27, and the replacement-indicator material 28 have a clearly visible and clearly distinguishing color.

Figure 2D:
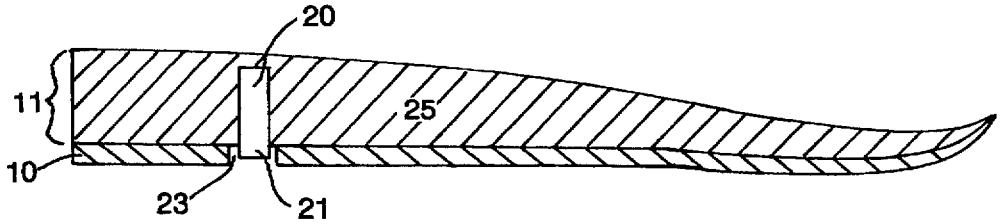
FIG. 2D illustrates a protrusion structure which does not extend through the outsole onto the ground surface, but extends only part way into the outsole protrusion cup. In this case, wear and midsole compaction are shown by the distance into the outsole protrusion cup the bottom of the protrusion structure extends.

FIG. 2D presents another embodiment of the invention in which the protrusion nipple 21 is recessed and does not extend out through the protrusion cup 23, but extends only part way into the cup 23. In this case, compaction and wear can be shown by the distance into the cup 23 that the bottom of the protrusion nipple 21 extends. The degree of extension can be further facilitated by coloring, highlighting, marking, etc., the inside of the protrusion cup 23 with an indicating color so that when the bottom of the protrusion nipple 21 extends beyond a specific distance, the indicator color is obscured, signaling a condition of excessive wear and compaction and a need for shoe replacement.

Another embodiment of the protrusion structure 20 of the invention is illustrated in FIGS. 3 and 4 in which the protrusion structure 20 is exemplified as a rectangular parallelepiped forming a stripe 24 along the bottom of the outsole 16. This stripe 24 need not be rectilinear in shape, as the present invention encompasses protrusion structures 20 of any geometry that satisfies or that is effective or advantageous in functioning as an indicator of shoe wear according to the invention.

Figure 3A:
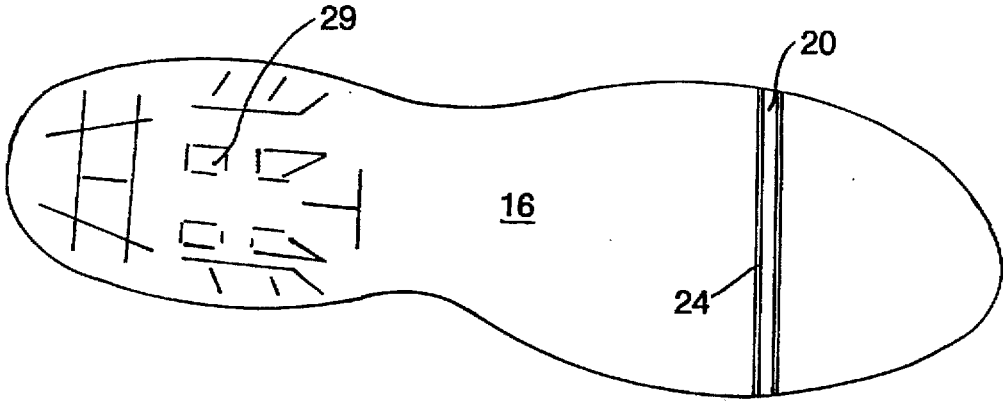
FIG. 3A presents a bottom view of a shoe of the invention wherein a wear-detector device is viewed as a stripe across the width of the shoe.
Figure 3B:
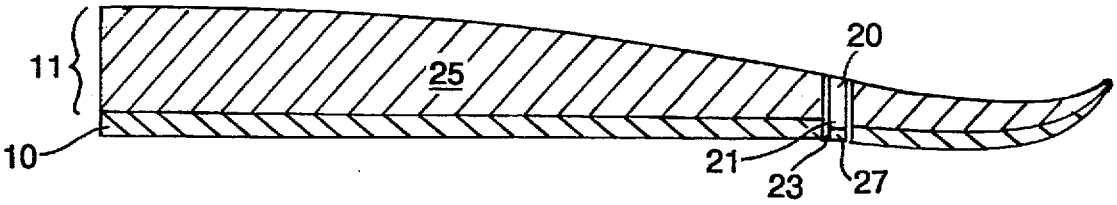
FIG. 3B is a schematic cross-sectional side view of a wear-indicator stripe (a pronation/supination stripe) wherein the wear-indicator stripe extends to the ground surface exposing a distinguishing tag.

In FIG. 3A the protrusion structure 20 is viewed as a stripe 24 across the bottom of the shoe which, in side view (FIG. 3B) is shown to comprise a protrusion nipple 21 containing wear-indicator material 27 at the bottom end of the protrusion nipple 21; the protrusion nipple 21 extends into the outsole protrusion cup 23.

Figure 3C:
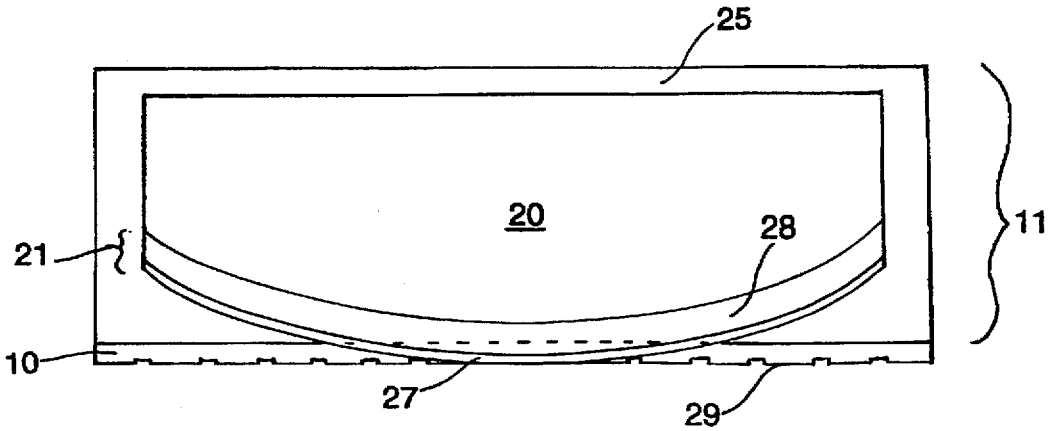
FIG. 3C is a schematic cross-sectional side view of a wear-indicator stripe having a curvature in medial-lateral cross-section to detect wear and midsole compaction due to pronation or supination foot action.

As shown in FIG. 3C, the protrusion structure 20 can have (but need not have to make this technology functional) a curvature in medial-lateral cross-section in order to more advantageously facilitate the detection of wear and midsole compaction due to pronation or supination action resulting from the rolling motion of the foot. The wear-indicator material 27 at the lower end of the protrusion nipple 21 would wear as the protrusion structure 20 is forced into contact with the ground due to compaction of the midsole material 25 and/or wear of the outsole 10 along the tread surface 29. A replacement-indicator material 28 can be placed over the wear-indicator material 27.

While still in the embodiment illustrated in FIG. 3C, the curvature of the protrusion structure 20 would be expected to wear differentially, i.e., to a greater extent at the middle area of the curvature than at either end of the curvature. A specific wear pattern is reflective of, and diagnostic of, the biomechanical compatibility between the wearer and the shoe, due to factors such as Q-angle, shoe-leg alignment, heel striking characteristics, style and force of running, etc.

A deviation in wear pattern from the expected pattern of wear would result, for example, from a wobble or rolling action of the wearer's foot. Thus, a protrusion structure 20, preferably having a curvature, for example, as illustrated in FIG. 3C, can serve as a useful indicator and diagnostic of the extent of pronation/supination action in an individual wearer or runner. Such an indicator and diagnostic of pronation/supination action would further suggest from indications of the degree of compaction and wear in the critical extremities of the midsole 11 and outsole 10 structures, the serviceable life of the shoe and the type of compensation or correction required to support and correct a detected condition of overpronation or oversupination.

Figure 4A:
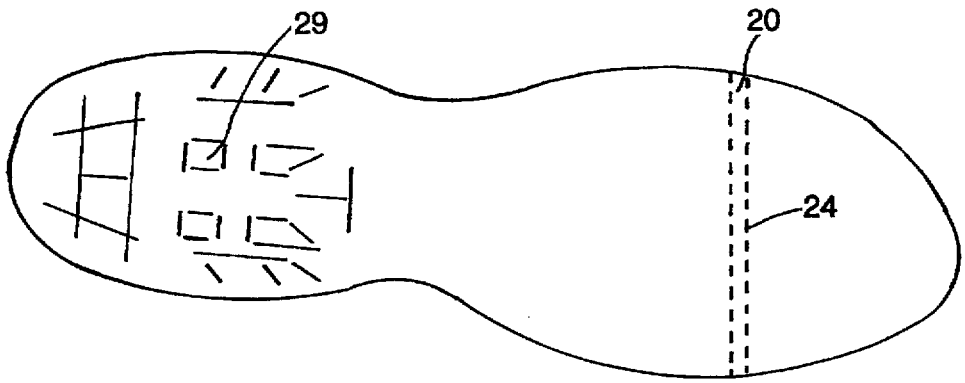
FIG. 4 presents views of a shoe comprising a wear-indicator stripe (a pronation/supination stripe) that is not visible from the bottom view of the shoe (FIG. 4A).
FIG. 4B is a schematic cross-sectional side view of such a non-visible wear-indicator stripe showing the relationship between the protrusion nipple and the outsole which, in this case, comprises a wear-indicator layer.
FIG. 4C illustrates a schematic cross-sectional view of a wear-indicator stripe having a curvature in medial-lateral cross-section and positioned so as to be invisible from a bottom view of the shoe. The protrusion nipple extends from the midsole into an outsole protrusion inset capped with a layer comprising a wear-indicating material positioned atop the outsole tread surface.
Figure 4B:
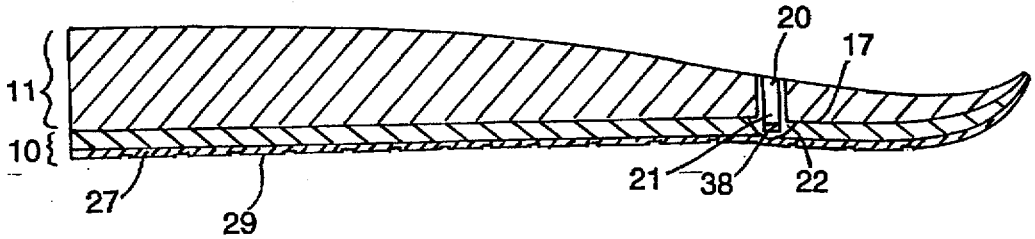

A variation of the embodiment illustrated in FIG. 3C is presented in FIG. 4. In this case, as illustrated in FIGS. 4A–B, the pronation stripe 24 is not visible from the bottom of the outsole tread surface 29, but is constructed to be contained entirely internally. As shown in FIG. 4B, a protrusion structure 20 within the midsole 11 presses against the inner surface of the outsole 17 as compaction of the midsole occurs, while at the same time the outsole tread 29 continues to wear. The wearing away or erosion of the tread surface 29 eventually exposes a wear-indicator material 27, built into the outsole 10, by revealing, for example, a unique color or other distinctive marker, and thus indicating to the user that excessive wear or compaction of the midsole 11 had occurred. An advantage of the embodiment illustrated herein is that the midsole 11 and the protrusion structure 20 are completely sealed by the outsole 10, requiring a shoe construction that is conventional and consonant with existing methods for bonding the outsole 10 with the midsole 11.

Figure 4C:
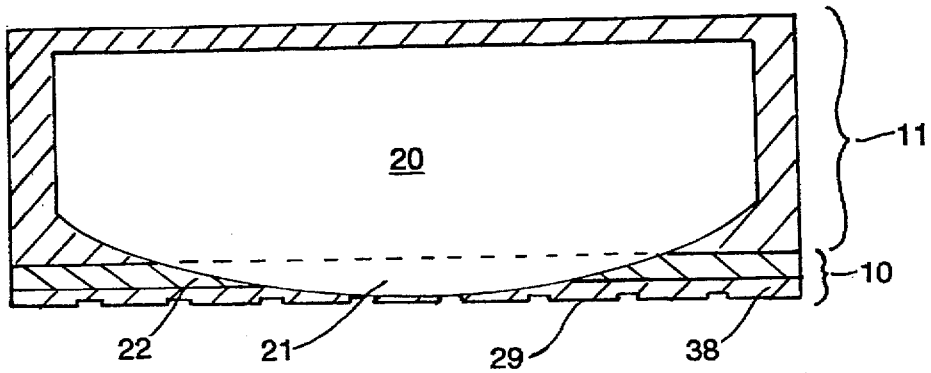

FIG. 4C illustrates a protrusion structure 20 having a curvature in medial/lateral cross-section in order to more advantageously facilitate the detection of wear and midsole compaction due to pronation or supination action. As the protrusion structure 20 is forced deeper into the outsole 10 with continued wear, the wear-indicator layer 38 of the outsole would penetrate a worn outsole tread surface 29, signalling extended wear of the outsole, loss of ability to cushion and absorb shock, and a need for shoe replacement.

Thus, in the particular embodiments of the invention shown in FIGS. 2–4, with increased shoe wear, the degree of extension of the protrusion nipples 21 into the outsole protrusion inset 22 is enhanced and, at the same time, the bottom sides of the outsole protrusion insets 22 are progressively eroded such that the protrusion nipples 21 become visible through the bottom surface of the outsole 10, hence providing a means for indicating compaction and indicating an excessive and unacceptable level of midsole material breakdown. It was also illustrated that with increased shoe wear, the degree of extension of the protrusion nipples 21 into the outsole protrusion cups 23 is enhanced progressively, such that, eventually, the protrusion nipples 21 become visible to the consumer, thereby signaling excessive midsole material breakdown and a need for shoe replacement.

In these embodiments, the visible display or appearance of the protrusion structures 20 through the outsole 10 signals to the consumer that a high level of midsole breakdown and compaction is occurring with a concomitant loss of shock-absorptive capability and that the shoes should be replaced. At the same time, the visibility of the protrusion structures at the bottom surface of the outsole 16 or the tread surface 29 (see exemplification in FIG. 5) also provides information concerning the individual wear profile or wear pattern of the wearer. The present invention contemplates the use of a plurality of protrusion structures 20 arranged in strategic patterns and/or densities around the dimension of the shoe sole area to ensure detection of wear level, wear pattern and usability over the entire sole area.

Figure 5A:
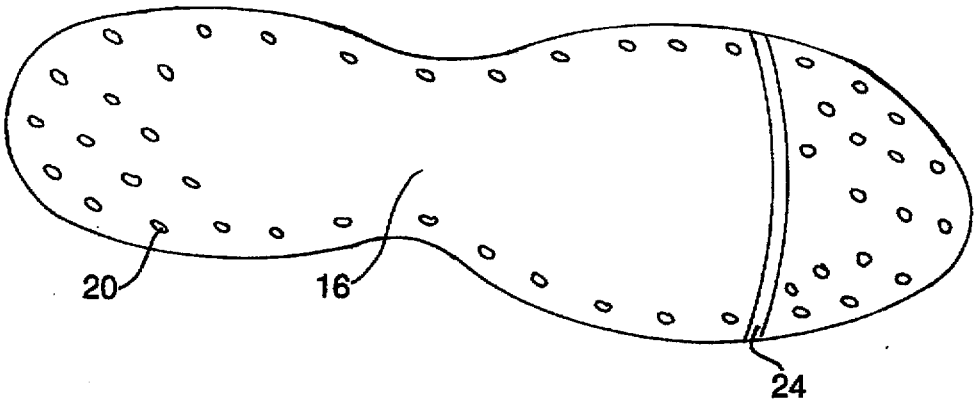
In FIG. 5A is illustrated an example of a particular pattern which can be used for the strategic positioning of built-in wear-detector devices.
Figure 5B:
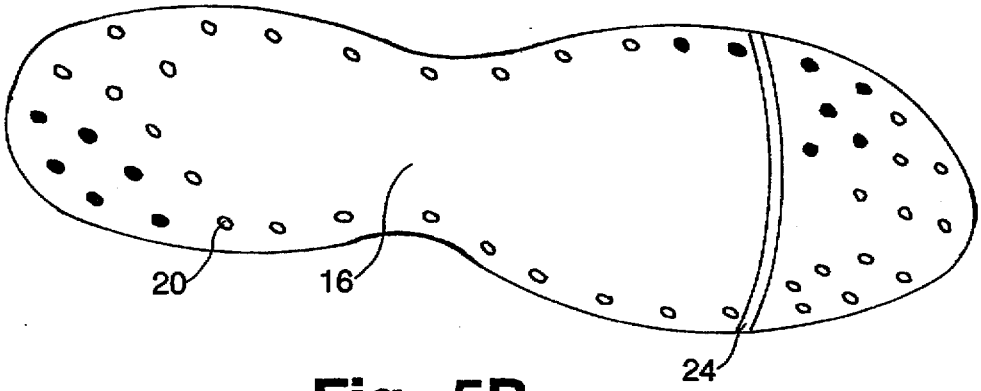
Figure 5C:
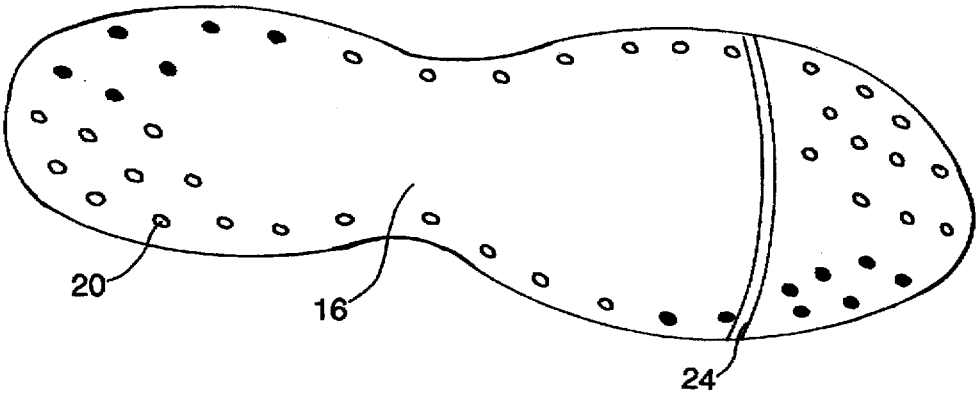
FIG. 5C shows a possible wear pattern of an over-supinator.

FIG. 5A exemplifies a particular pattern for the placement of protrusion structures within the shoe. As would be appreciated in the art, protrusion structures can be situated in various different and/or specific patterns, designed to serve a particular purpose, e.g., to detect a wobble, supination, etc., or to benefit a particular user, e.g., a pronator, etc. FIG. 5B exemplifies a wear-pattern potentially caused by an over-pronator, while FIG. 5C shows a possible wear pattern of an over-supinator. The detection of a specific wear pattern, different from standard or usual wear patterns, alerts the wearer of the existence of a potentially problematic condition.

It is highly preferred that the protrusion structure 20, and in particular the protrusion nipple 21, be easily visible or detectable to the naked eye when observed from the bottom of the outsole. For example, the protrusion structures 20 or protrusion nipples 21 may be colored or multi-colored, preferably with color(s) that are easily distinguished from the color of the outsole 10, e.g., with bright colors, fluorescent colors, etc. The protrusion structure 20 or protrusion nipple 21 may also be made detectable by affixing a signal or tag, e.g., magnetic, etc. to the bottom surface of the protrusion nipple 21 which is visible to the naked eye or detectable by appropriate detector or machine.

The invention is further exemplified by embodiments in which the wear-indicator device is a wear-indicator outsole. In particular, the built-in wear-indicator technology of the invention is specifically incorporated into the outsole 10 in such a manner as to form a wear-indicating outsole 30. A simple embodiment of a wear-indicating outsole 30 is schematically presented in FIG. 6.

Figure 6:
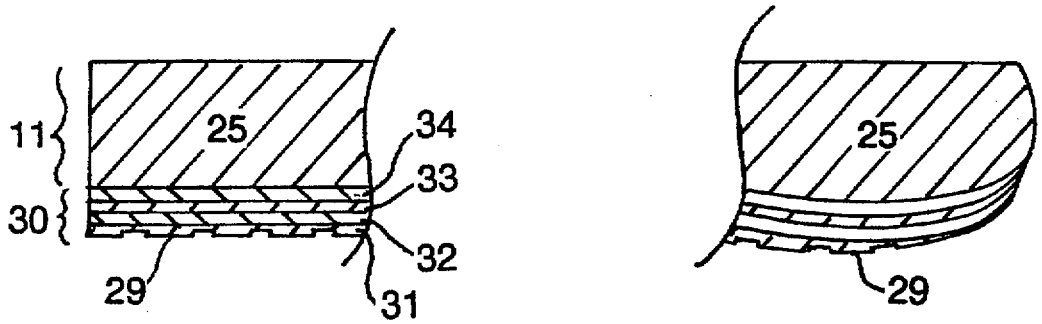
FIG. 6 is a schematic side view of a wear-indicator outsole comprised of a plurality of wear-indicating layers.

In FIG. 6, the wear-indicating outsole 30 is comprised of a plurality of layers, as indicated generally as 31–34, each layer being made from substantially the same material as used conventionally to form an outsole in bulk, and each layer being individually distinct and distinguishable from each of the remaining layers, for example, by a specific color or other such distinct and distinguishing feature. The function of the device is to readily indicate wear by revealing sequentially color or colors as the outsole tread surface 29 is worn away through use.

In the specific color scheme shown in FIG. 6, the unused tread surface when the shoe is purchased new would be, for example, black in color, as indicated generally as layer 31. As the tread surface 29 wears at any point on the outsole bottom surface, the next layer 32, green in this specific embodiment, would be revealed. This indicates to the user that wear of the outsole tread surface 29 is occurring and, indirectly, that compaction of the midsole material is also concomitantly occurring. As additional layers are revealed, for example, a green layer 33 followed by a red layer 34, the increased degree of wear is readily indicated and the user can gauge the useful life remaining in the shoe. As the degree of wear is also directly correlated with the degree of compaction of the midsole material 25 with continued wear, the consumer can readily determine when the shoe should be replaced, for example, the appearance of a red color can signal the loss of cushioning capacity and, concomitantly, the need for shoe replacement.

The invention further contemplates the use of the tread bottom or wear indicator layer to reveal a particular format, for example, a particular shape (e.g., a logo) or word (e.g., "replace"), name, number, character, or message (e.g., "get new pair free"). The appearance of the above shapes, words, numbers, messages, etc. on the bottom or tread surface could be used to monitor, control and stimulate replacement of the shoe and could further be utilized for marketing purposes, sales promotions and advertising.

Figure 7:
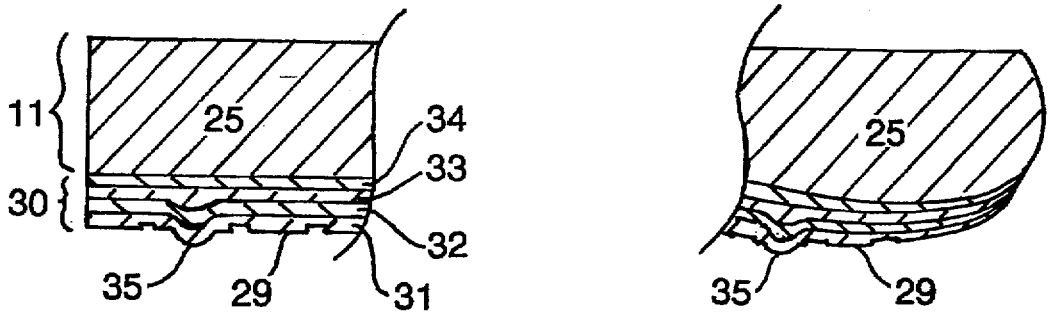
FIG. 7 is a schematic side view of a wear-indicator outsole comprising wear blisters; the wear blisters, like the outsole, are comprised of a plurality of wear-indicating layers.

A particular embodiment of the wear-indicating outsole 30 of the invention is illustrated in FIG. 7. In this embodiment, a wear blister or wear blisters 35 are added to the tread surface 29, which can be of arbitrary, but beneficial, geometry for traction, shock absorption and control. The wear blisters 35 provide key contact points for the outsole to the ground running surface and are designed to show wear first by revelation of the multi-colored layers, e.g., 32–34. Any indicating color scheme can be used in an arbitrary manner to signal the shoe user when significant wear has occurred. The color scheme as exemplified in FIG. 7 comprises, atop an outermost black colored tread surface 31, a green layer 32, followed by a yellow layer 33 and then a red layer 34; this specific color scheme is particularly instructive and intuitive, since the order of colors emulates that of a stoplight traffic function to tell the user when to exercise caution in using the shoes and when to stop using the shoes altogether.

Figure 8:
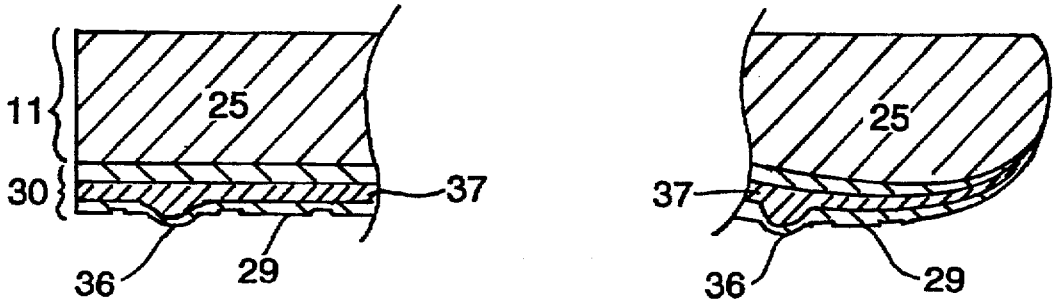
FIG. 8 is a schematic side view of a wear-indicating outsole comprising filled wear blisters, the filled wear blisters containing an easily detectable, wear-indicating material.

FIG. 8 illustrates a simpler embodiment of the wear blister of the invention, designated as a filled wear blister, indicated at 36. In this embodiment, the wear blister on a new, unused shoe possesses a specific color on its exterior surface and is filled with conventional outsole material of a different, and preferably contrasting or distinguishing, color 37, e.g., red. With wear, the distinguishing color layer 37 is revealed, indicating to the user that the shoe is wearing and further indirectly correlating the compaction of the midsole material 25 to the actual shoe wear.

Figure 9A:
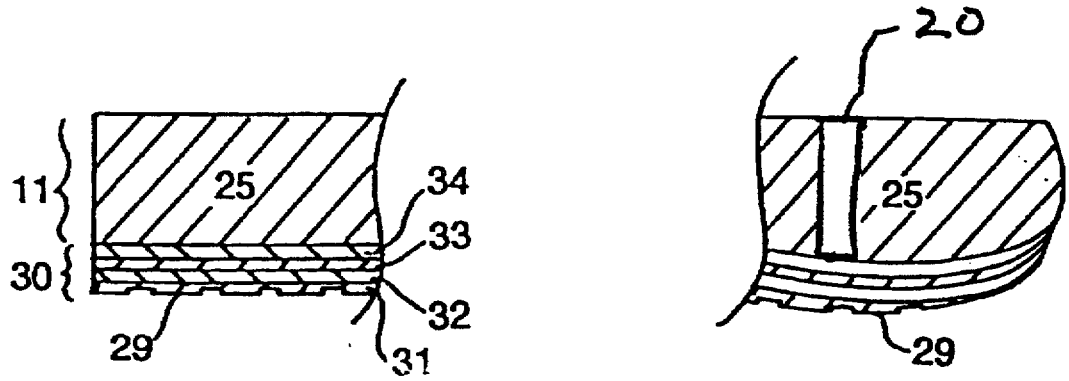
FIG. 9A shows a combination of the protrusion structure with the wear-indicating outsole.
Figure 9B:
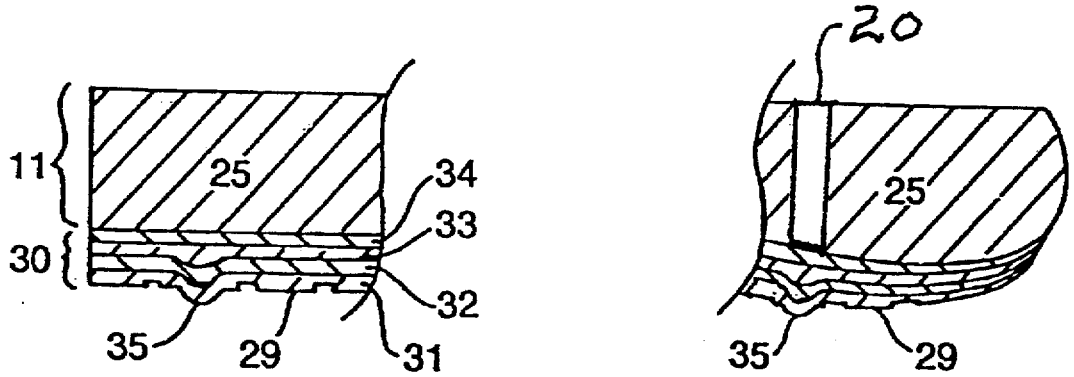
FIG. 9B shows an embodiment wherein the wear-indicating outsole has a wear blister.

It is further contemplated by the invention that the different embodiments of the wear-indicating outsole, for example, as illustrated in FIGS. 6, 7 and 8, can be combined with or incorporated into the different embodiments of the protrusion structures 20 illustrated in FIGS. 1–4. The combination is illustrated in FIGS. 9A–B. In these cases, the outsole wear surface 16 or the wear blister 35 and 36 would reside underneath the protrusion structure 20 to receive specific wear forces, as illustrated in FIG. 9B, thus indicating wear and directly indicating compaction of the midsole material 25. In these combinations of different embodiments of the invention, the compaction of the midsole material 25 would directly contribute to the wear and revelation of the various layers, e.g., different color layers indicated as 31–34.

Further, as illustrated in FIG. 5, the wear blisters 35 and 36 and/or the protrusion structures 20 can be arranged in a pattern or density most efficient to aid in the diagnosis of the extent of wear and midsole compaction at various points of the shoe. In particular, the pattern and/or density selected would be beneficial and/or corrective to the specific indication and to the diagnosis of running or athletic stride characteristics.

The following examples use many techniques well-known and accessible to those skilled in the art. It will be apparent to those of ordinary skill in the art that alternative methods, toolings, procedures and techniques other than those specifically detailed herein can be employed or readily adapted to practice the methods of making and of using the shoes of the present invention. In particular, variations in the geometry and dimensions of the wear-indicator device, of the location and orientation of the wear-indicator device, and of the materials and technologies underlying the construction of all parts of the shoe of the invention are all deemed to be encompassed by the present invention and accessible to those skilled in the art, based upon the examples of the invention herein described. Such alternative methods, toolings, procedures and techniques are within the spirit and scope of this invention.

All references cited in the present application are expressly incorporated by reference herein.

The compositions and methods of this invention are illustrated in the above non-limiting examples. All abbreviations used herein are standard abbreviations in the art. Specific procedures not described in detail in the examples are well-known in the art. Any variations in the exemplified compositions and methods which occur to the skilled artisan are intended to fall within the scope of the present invention.

What is claimed is:

1. A wear-indicator shoe comprising:

an outsole presenting a surface-contacting bottom;

a midsole overlying said outsole;

a built-in wear-indicator device vertically disposed within said midsole, said wear-indicator device being less compactible than said midsole; and a means for indicating compaction of said midsole and the consequent need for replacement of said shoe, said means for indicating compaction utilizing said wear-indicator device.

2. The shoe of claim 1 wherein said wear-indicator device has a shape selected from the group consisting of a cone, a rectangle, a cylinder, a plug and a stripe.

3. The shoe of claim 1 wherein said wear-indicator device comprises a body having a wear-indicating material at the bottom thereof, said wear-indicating material being distinguishable from said body of said wear-indicator device.

4. The shoe of claim 3 wherein said wear-indicator material comprises a colored layer.

5. The shoe of claim 4 wherein said wear-indicator material comprises a plurality of colored layers, each colored layer being distinguishable from the remaining colored layers.

6. The shoe of claim 1 wherein said wear-indicator device has a bottom surface having a shape selected from the group consisting of a logo, a word, a name, a number, a character, a cartoon and a message.

7. The shoe of claim 1 wherein said wear-indicator device spans completely through said midsole.

8. The shoe of claim 1 wherein said outsole has a protrusion cup therein, wherein said wear-indicator device protrudes into said protrusion cup.

9. The shoe of claim 1 wherein said outsole has a protrusion inset therein, wherein said wear-indicator of device protrudes into said protrusion inset.

10. The shoe of claim 1 wherein said wear-indicator device comprises a stripe, a portion of which is situated within said outsole, said stripe substantially spanning the width of said outsole and having a surface-contacting bottom.

11. The shoe of claim 10 wherein said stripe is overlaid with a wear-indicating material that is distinguishable from said stripe, and wherein said wear-indicating material comprises a colored layer.

12. The shoe of claim 10 wherein said stripe is overlaid with a wear-indicating material that is distinguishable from said stripe, and wherein said wear-indicating material comprises a plurality of colored layers, each colored layer being distinguishable from the remaining colored layers.

13. The shoe of claim 10 wherein said wear-indicator device has a curvature in medial-lateral cross-section.

14. The issue of claim 1 wherein said wear-indicator device comprises a stripe substantially spanning the width of said shoe and having a portion contained within said outsole such that said stripe is invisible from said surface-contacting outsole bottom.

15. The shoe of claim 14 further comprising a wear-indicating material overlaid on said surface-contacting outsole bottom and distinguishable therefrom.

16. The shoe of claim 15 wherein said wear-indicating material comprises a plurality of colored layers, each colored layer being distinguishable from the remaining colored layers.

17. The shoe of claim 1 wherein said outsole is a wear-indicator outsole comprising a plurality of layers, each layer being distinguishable from each of the other layers.

18. The shoe of claim 17 wherein said plurality of layers is a plurality of colored layers.

19. The shoe of claim 17 wherein said outsole further comprises a blister providing a contact point between said outsole and the ground.

20. The shoe of claim 19 wherein said wear-indicator device is positioned over said blister.

21. The shoe of claim 19 wherein said blister is filled with a material distinguishable from said surface-contacting bottom.

22. A wear-indicator shoe comprising:

an outsole presenting a surface-contacting bottom;

a midsole overlying said outsole;

a built-in wear-indicator device vertically disposed within said midsole, said wear-indicator device being less compactible than said midsole; and a means for indicating the extent of protrusion of said wear-indicator device into said outsole.

23. The wear-indicator shoe of claim 22 wherein said indicating means comprises an element of said wear-indicator device having a cross-sectional dimension that varies along the vertical dimension thereof, for observing an exposed cross-sectional dimension of said element.

24. The wear-indicator shoe of claim 23 wherein said wear-indicator device is cone shaped.

25. The wear-indicator shoe of claim 23 wherein said wear-indicator device has a curvature in medial-lateral cross-section.

26. The wear-indicator shoe of claim 25 wherein said wear-indicating device is a stripe substantially spanning the width of said outsole.

27. The wear-indicator shoe of claim 22 wherein said outsole has a protrusion cup therein, wherein said wear-indicator device protrudes into said protrusion cup, and wherein said indicating means comprises indicating markings on the side of the said protrusion cup for observing the degree of extension of said wear-indicator device into said protrusion cup.

28. The wear-indicator shoe of claim 27 wherein said markings comprise colors.

29. The wear-indicator shoe of claim 22 wherein said indicating means comprises a plurality of colored layers on said wear-indicator device for observing an exposed color.

30. The wear-indicator shoe of claim 29 wherein said wear-indicator device is initially contained entirely internally.

31. The wear-indicator shoe of claim 30 wherein said wear-indicator device initially protrudes partially into said outsole.

32. The wear-indicator shoe of claim 22 wherein said indicating means comprises a tag on said wear-indicator device for transmitting a detectable signal.

33. The wear-indicator shoe of claim 32 wherein said signal is a magnetic signal.

34. The wear-indicator shoe of claim 22 comprising a plurality of built-in wear-indicator devices vertically disposed within said midsole, each of said wear-indicator devices being less compactible than said midsole.

35. The wear-indicator shoe of claim 34 wherein said wear-indicator devices are distributed around said midsole to provide an indication of wear level over the entire sole area.

36. The wear-indicator shoe of claim 34 wherein said wear-indicator devices are distributed in a pattern to provide an indication of the individual wear pattern of the wearer.

37. The wear-indicator shoe of claim 36 wherein said wear-indicator devices are distributed in a pattern to provide indication of pronation or supination of the wearer.

38. A wear-indicator shoe comprising:

an outsole presenting a surface-contacting bottom;

a midsole overlying said outsole; and a built-in wear-indicator device vertically disposed within said midsole, said wear-indicator device being less compactible than said midsole, said wear-indicator device comprising a plurality of colored elements.

39. The wear-indicator shoe of claim 38 wherein said colored elements are colored layers.

40. The wear-indicator shoe of claims 38 wherein said wear-indicator device comprises a stripe overlaid with a wear-indicating material.

41. The wear-indicator shoe of claim 38 wherein said wear-indicator device comprises a cylinder.

* * * * *